US006744996B2

(12) United States Patent
Brenner

(10) Patent No.: US 6,744,996 B2
(45) Date of Patent: Jun. 1, 2004

(54) METHOD OF DETERMINING LIQUID TONER DEPLETION

(75) Inventor: Robert E. Brenner, New Richmond, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/285,385

(22) Filed: Oct. 31, 2002

(65) Prior Publication Data

US 2004/0086290 A1 May 6, 2004

(51) Int. Cl.[7] ..... G03G 15/10
(52) U.S. Cl. ..... 399/57
(58) Field of Search ..... 795/27, 29, 30, 795/57, 58, 62; 118/689, 690, 691; 324/71.1

(56) References Cited

U.S. PATENT DOCUMENTS

| | | | | |
|---|---|---|---|---|
| 4,524,088 A | | 6/1985 | Fagen, Jr. et al. | 427/10 |
| 4,648,702 A | | 3/1987 | Goto | |
| 5,003,352 A | | 3/1991 | Duchesne et al. | |
| 5,229,821 A | | 7/1993 | Fujii | |
| 5,447,056 A | * | 9/1995 | Foote | 399/57 |
| 5,530,530 A | | 6/1996 | Tanaka et al. | |
| 5,815,768 A | | 9/1998 | Clifton | 399/27 |
| 5,970,273 A | * | 10/1999 | Zenk et al. | 399/12 |
| 5,995,778 A | * | 11/1999 | Yamaguchi | 399/57 |
| 6,104,890 A | | 8/2000 | Kim | 399/46 |
| 6,154,620 A | * | 11/2000 | Hagiwara | 399/57 |
| 6,253,036 B1 | | 6/2001 | Karakama et al. | 399/27 |
| 6,330,406 B1 | * | 12/2001 | Yamaguchi | 399/58 |
| 6,337,959 B1 | | 1/2002 | Kwak et al. | 399/57 |
| 6,349,184 B2 | | 2/2002 | Otomo | 399/27 |

FOREIGN PATENT DOCUMENTS

JP 63-303380 A * 12/1988

* cited by examiner

*Primary Examiner*—William J. Royer
(74) *Attorney, Agent, or Firm*—Mark A. Litman & Associates, P.A.

(57) ABSTRACT

A method of determining when liquid electrophotographic toner has been depleted using a means of detecting signals indicating the conductivity provided by toner solids in a liquid carrier and determining their concentration in relationship to the liquid dielectric carrier solvent.

17 Claims, 2 Drawing Sheets

METHOD OF DETERMINING LIQUID TONER DEPLETION

BACKGROUND OF THE INVENTION

1. Field of the Invention

This invention relates to an electrophotographic apparatus that uses liquid toner and particularly relates to a method of determining the percentage of toner solids in the liquid toner while the liquid toner is in the printer.

2. Background of the Art

In electrophotography, an organophotoreceptor in the form of a plate, belt, disk, sheet, or drum having an electrically insulating photoconductive element on an electrically conductive substrate is imaged by first uniformly electrostatically charging the surface of the photoconductive element, and then exposing the charged surface to a pattern of light. The light exposure selectively dissipates the charge in the illuminated areas, thereby forming a pattern of charged and uncharged areas. A liquid or dry ink is then deposited in either the charged or uncharged areas to create a toned image on the surface of the photoconductive element. The resulting visible ink image can be fixed to the photoreceptor surface or transferred to a surface of a suitable receiving medium such as sheets of material, including, for example, paper, polymeric materials, metal, metal coated substrates, composites and the like. The imaging process can be repeated many times on the reusable photoconductive element.

In some electrophotographic imaging systems, the latent images are formed and developed on top of one another in a common imaging region of the organophotoreceptor. The latent images can be formed and developed in multiple passes of the photoconductor around a continuous transport path (i.e., a multi-pass system). Alternatively, the latent images can be formed and developed in a single pass of the photoconductor around the continuous transport path by sequential imaging and electrostatic deposit of toner. A single-pass system enables the multi-color images to be assembled at extremely high speeds relative to the multi-pass pass system. At each color development station, liquid color developers are applied to the photoconductor, for example, by electrically biased rotating developer rolls. The color developer may be dry pigment particles or it may be a liquid ink made of small colored pigment particles dispersed in an electrically insulating liquid (i.e., a carrier liquid).

This colored developer is provided for use in the printing apparatus usually through an exchangeable developer cartridge, but occasionally also through "refilling" of the initial cartridge. It is, therefore, necessary for the user to be informed of the time such an exchange of cartridges or refill of the cartridge becomes necessary. As a result of this need, many different methods of determining toner cartridge life are known. Some of these methods work best with liquid toner; others are best used with dry toner.

The typical dry developer cartridge contains a sensor that is used to determine when the physical quantity of remaining toner drops below a predetermined level. Frequently this level is determined by applying a bias to one probe, roll, member or other element associated with the cartridge and reading that bias across a predetermined gap with another roll, probe, element or member. When the toner level is high, the current is transmitted easily from one probe to the next. When the toner level is low, air fills the gap and the machine is less able or unable to sense the current from the biased member, signaling to a controller that a "change cartridge" indicator is to be activated. See U.S. Pat. Nos. 5,229,821 and 6,349,184 for examples of that format of toner level indication system. This type of sensor is essentially an on/off sensor, asking if there is toner in the cartridge or not.

For liquid electrophotography, a cartridge change indicator is not nearly so simple as the formats that may be used with dry or powder toner systems. As the toner particles within the liquid toner are transferred to the photoreceptor, fewer and fewer toner particles remain within the liquid. The concentration of toner particles in the toner liquid are not necessarily uniformly constant in the deposited or transferred toner, changing the concentration of toner particles in the liquid, although the level of liquid in the cartridge might remain the same or very nearly the same. Some prior art uses a light beam and window to determine the optical density of the liquid in the developer pod. If the optical density is above a certain value, there are enough toner particles in the developer to keep printing images of useful optical density levels. One problem with this solution is that sometimes the toner particles adhere to the window through which the light beam is directed at the liquid toner, causing the optical density measurement to be falsely high and failing to notify the user that the cartridge does not contain sufficient toner to keep printing. See U.S. Pat. No. 5,530,530 for one example. U.S. Pat. No. 6,337,959 also discloses in its background three additional conventional liquid level measuring apparatuses or methods.

SUMMARY OF THE INVENTION

To solve some of the problems associated with determining when it becomes necessary to exchange or refill a liquid toner cartridge, an easier method can be implemented by determining what concentration of toner solids remains in the liquid. This can be determined independently of or in concert with a determination of the absolute amount (weight or volume) of the liquid toner remaining. When that determined percentage falls below a unique threshold, it is time to change the cartridge, add a concentrate to raise the particle level (replenishment) or add toner (replacement). This concentration determination is not the same as measuring what quantity of liquid is in the cartridge, as with dry toner, since the liquid level may vary within a wide range of acceptable limits, while the actual concentration of charged toner particles in the liquid is what is being measured as an important determinant in toner replacement or replenishment.

In the invention, a method for determining the concentration of toner solids present or remaining in any quantity of liquid solvent is described. One embodiment of the invention involves a series of steps. An electrical signal generator is electrically connected to a first electrode. A second electrode, attached or electrically connected to a detecting device, is positioned at a prescribed gap distance (e.g., between 0.005 inches and 0.250 inches) from the first electrode. The two electrodes are submerged in a liquid printing ink (in the practice of the invention in an electrophotographic imaging system, within the toner cartridge), maintaining the prescribed gap distance from one another. The signal generator then transmits an alternating current electrical signal (AC signal) or a direct current signal (DC signal) having a known amplitude to the first electrode. The direct current signal may be pulsed, and the receiving/signaling system may respond to the lack of pulses over a period of time to indicate depleted toner. The second electrode then receives any residual signal that is transmitted or propagates across the prescribed gap distance. The amplitude of the received signal is either detected at an acceptable intensity or determined to be absent or below the acceptable level, and a warning is generating based on whether the signal is received at the acceptable level or not received at an acceptable level (the unacceptable level including no signal received). Additionally, decisions may be made based on the amplitude of the received signal.

In one embodiment of the method, the signal generator's output is, by way of a non-limiting example, between about 0.1 and 10 MHz, e.g., between 0.5 and 5 MHz, such as at 1 MHz. In a preferred embodiment of the method, the first and second electrical emitting and electrical sensing elements, e.g., the probes are between 0.035 inches and 0.045 inches apart.

There are various possible embodiments and formats of positioning of the detection device element that may be used to send the "change ink" message. In the most basic embodiment, the electrical path is in a simple series connection with the sensing device. When insufficient current is received at the second electrode, the electrical series connection is broken and a light, LED, or other signaling device ceases to relay a message to a receiver or fails to provide a visual signal that the cartridge or ink is still good. In this embodiment, the absence of the signal to an observer is the warning indicator or the absence of the internal light signal may trigger a second imaging feature to engage to provide a visible light signal.

In another embodiment, the AC signal is converted to analog and can be read, interpreted or processed by such devices as meters, processors, and the like. In such an embodiment, the percentage of toner solids remaining in a cartridge may be accurately determined at any given time.

The invention includes a method for determining the percentage of toner solids remaining in liquid printing ink within a liquid printing ink storage device or use cartridge comprises the steps of providing an electrical signal generator on the storage device providing a first electrode electrically connected to the signal generator, the first electrode submerged in the liquid printing ink, providing a second electrode at a predetermined gap distance from the first electrode, the second electrode submerged in the liquid printing ink and connected to an electrical signal detector, transmitting an alternating current signal having an amplitude from the signal generator to the first electrode, detecting the AC signal or its absence with the electrical signal detector, determining the amplitude or absence of the AC signal at the second electrode, and generating a low toner solids warning signal in response to the amplitude being detected at the second electrode at an amplitude below a predetermined minimum level. The second electrode may be, by way of non-limiting examples, between 0.005 inches and 0.250 inches from the first electrode. The method may provide an indicator light that stays on in response to sufficient amplitude, and goes out in response to insufficient amplitude when the alternating or direct current signal is detected and its amplitude determined. The alternating current signal may be picked up at the second electrode by a detecting device which converts the alternating current signal to an analog signal. The resultant analog signal may be sent to a processor for conversion or translation into a warning indication for the user.

DETAILED DESCRIPTION OF THE INVENTION

For the purposes of this description, certain terms will have the following meanings:

Electrode—an electric conductor through which an electric current enters or leaves a medium, whether it be an electrolytic solution, liquid, gas, solid, molten mass, or vacuum. (Taken from McGraw-Hill Dictionary of Scientific and Technical Terms, $4^{th}$ Ed. 1989).

Liquid image developer—pigmented particles containing charge director combined with a dielectric liquid carrier or solvent.

Processor—any additional hardware that is used to amplify, rectify, process, microprocess, or otherwise convert the raw data or signal to a message or alert for a user.

Figure 1:
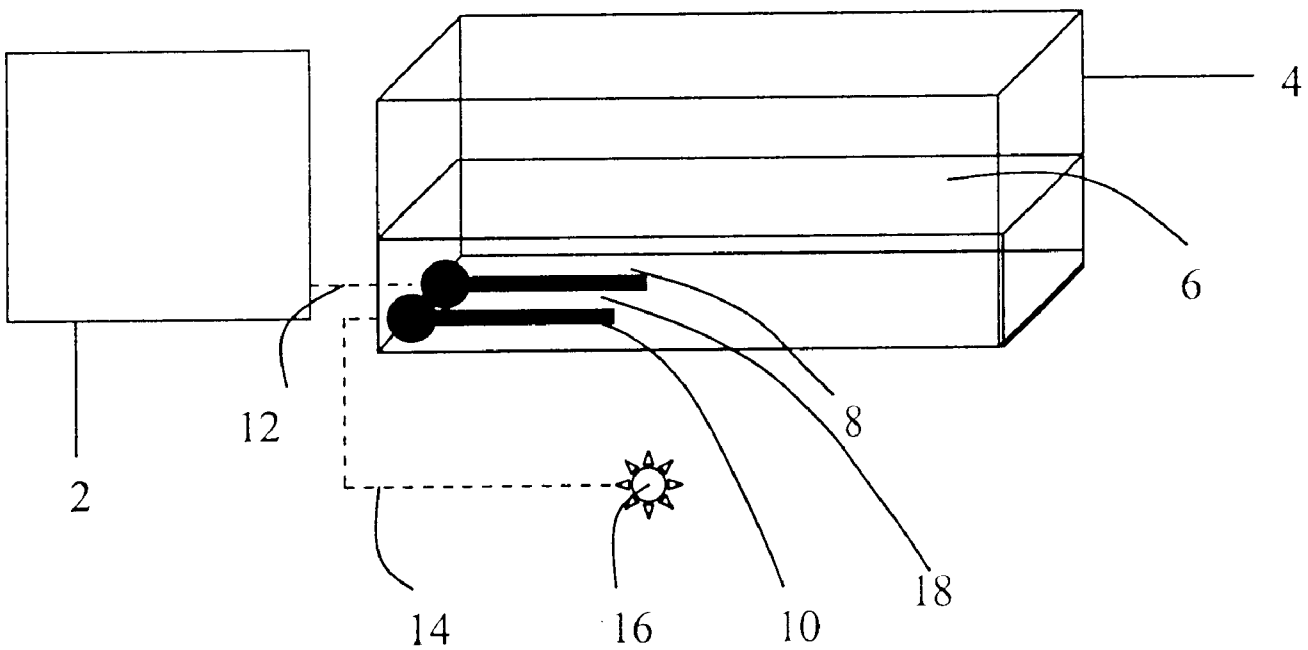
FIG. 1 shows a schematic drawing of an ink container with an electrical sensing system.

In FIG. 1, a signal generator 2 supplies an electrical signal (e.g., by way of non-limiting example, an AC signal) having a known amplitude (in this example, via a wire 12) to a first electrode 8 that is submerged in a container 4 of liquid image developer 6. A second electrode 10 is positioned between 0.010 and 0.250 inches from the first probe 8 to create a gap 18. Liquid image developer 6 is permitted to flow in the gap 18. The second electrode 10 is connected to a detector 16 which may be, by way of non-limiting example, as simple as a light bulb in series with the electrical signal path from the electrical signal generator, or which may include, for example, such components as an amplifier and/or rectifier, converter, chip, or microprocessing component. As the AC electrical signal sent through the first electrode 8 reaches the gap 18, it is conducted across the gap 18 to the second electrode 10 by conductive toner particles in the liquid image developer 6. If the concentration of charged toner particles in the liquid image developer is within minimal acceptable limits (e.g., a sufficiently high concentration), the AC signal is almost fully conducted or at least conducted to a minimally required level, and the amplitude of the AC signal closely approximates that of the generated signal or is maintained at a sufficiently high level as to indicate the presence of sufficient toner particles. As the charged toner particles are depleted from the dielectric liquid in the liquid image developer, the resistance in the gap increases and less of the AC signal reaches the second electrode and detector. As the amplitude received by the detector decreases to below a "trigger point" or pre-determined minimum level, a signal is generated (including even the light emitting element or bulb failing to be lit) to indicate to the user that the liquid image developer concentration is no longer viable for printing.

In a very basic embodiment, the detector can be a simple light bulb, for example. As long as the AC signal is sufficient to light the bulb, the concentration of solid conductive particles within the liquid ink is satisfactory. When the bulb is no longer illuminated, not enough of the AC signal is crossing the gap because of the absence of sufficient concentration of solid conductive particles, and the container of liquid image developer should be exchanged or renewed.

A much more complex embodiment utilizes more sophisticated hardware to detect the amplitude of the signal received at the second electrode. Hardware such as amplifiers, rectifiers, converters, chips, and microprocessors (or even a simple meter or look-up table) can all be additional steps that evaluate, measure, break down, or process, the signal received at the second electrode and help the user determine when to exchange or renew the liquid image developer. These additional steps and hardware inclusions are virtually limitless and are not necessary, though they may be preferred, for the function of the present invention. The following example will demonstrate the claimed method.

In the example below, it is shown that the signal detected at the second probe decreases as the percentage of solids in the toner decreases. This linear relationship can also be used in a processing function or look-up table to communicate to a sophisticated user exactly what percentage of toner solids remains.

EXAMPLE

In this system, the Norpar® 12 carrier has a dielectric constant of 2.01. When Norpar®-12 carrier liquid is mixed with the other ingredients (such as organosol and ink particles) the dielectric constant increases to about 2.3 to 2.5. As the ink is used this dielectric decreases the concentration of ink particles and the dielectric constant correspondingly decreases.

For this example, two conductive parallel plates are completely submersed in a hydrocarbon liquid tank (such as the Norpar®-12 carrier liquid used) to produce an analog voltage output from the detecting circuit. This output is adjusted to read zero volts when submersed in a pure hydrocarbon liquid in the absence of conductive particles.

The hydrocarbon liquid is emptied from the tank and replaced with an ink toner using Norpar®-12 hydrocarbon as a carrier fluid. The plates in the tank use the charged ink particles to complete the circuit and produce an analog voltage in relation to the toner particles present. Refer to graph 1 to see a diagrammatic representation of the apparatus.

Figure 2:
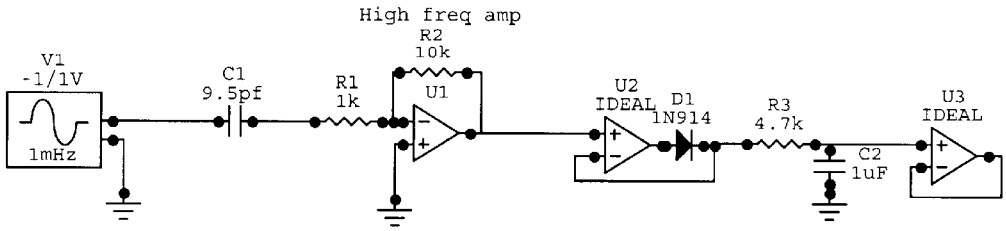
FIG. 2 shows a diagrammatic representation of a detector circuit.

The circuit below uses, by way of non-limiting example, a 1 Mhz sine wave across a capacitor (C1) submersed in liquid ink. Next the signal is amplified (U1) and converted to an analog voltage. The results show a linear output of percent solids versus output voltage from the circuit FIG. 2.

Figure 3:
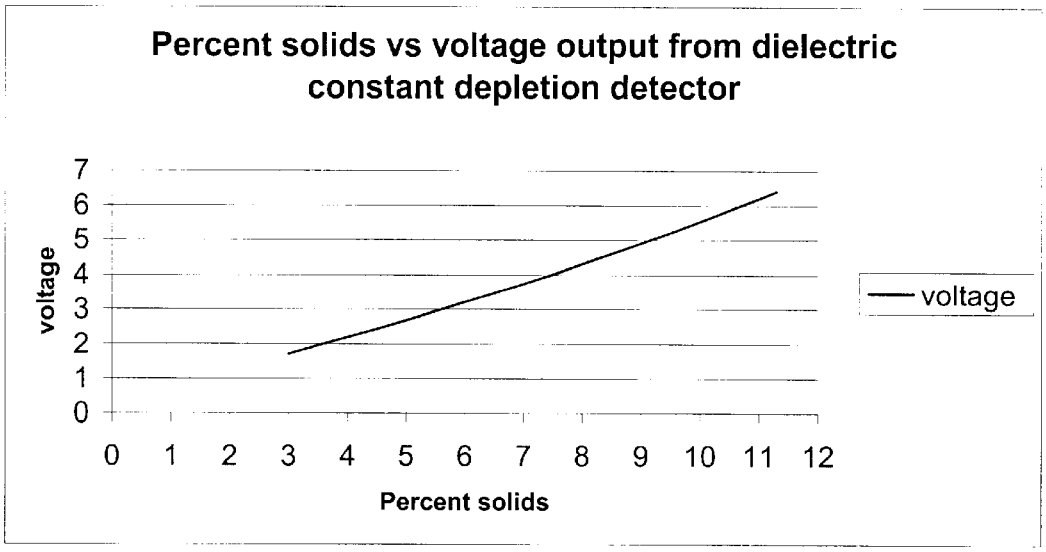
FIG. 3 shows a graphic representation of the voltage detected versus the concentration of solids in the toner.

Using the 11.3% solids ink a 3%, 6%, and 9% solution were made. The graph in FIG. 3 shows the liquid ink solids decrease and the output voltage from the detector decreases.

I claim:

1. A method for determining the percentage of toner solids remaining in liquid printing ink within a liquid printing ink storage device or liquid ink use cartridge comprises:

providing an electrical signal generator in signal communication with the storage device or cartridge;

providing a first electrode electrically connected to the signal generator, the first electrode in electrical contact with the liquid printing ink;

providing a second electrode at a predetermined gap distance across the liquid printing ink from the first electrode, the second electrode in electrical contact with the liquid printing ink and connected to an electrical signal detector;

transmitting an electrical current signal having an amplitude from the signal generator to the first electrode at 0.1 to 10 MHz;

detecting the electrical current signal or its absence with the electrical signal detector, determining the amplitude or absence of the electrical current signal at the second electrode, determining the dielectric constant from the electrical current signal and generating a low toner solids warning signal in response to the amplitude being detected at the second electrode at an amplitude below a predetermined minimum level.

2. The method of claim 1 performed on a replaceable liquid ink storage cartridge.

3. A method for determining the percentage of toner solids remaining in liquid printing ink within a liquid printing ink storage device or liquid ink use cartridge comprises:

providing an electrical signal generator in signal communication with the storage device or cartridge;

providing a first electrode electrically connected to the signal generator, the first electrode submerged in the liquid printing ink;

providing a second electrode at a predetermined gap distance from the first electrode, the second electrode submerged in the liquid printing ink and connected to an electrical signal detector;

transmitting an alternating current signal having an amplitude from the signal generator to the first electrode at 0.1 to 10 MHz;

detecting the alternating current signal or its absence with the electrical signal detector, determining the amplitude or absence of the alternating current signal at the second electrode, determining the dielectric constant from the alternating current signal, and generating a low toner solids warning signal in response to the dielectric constant determined from the amplitude being detected at the second electrode at an amplitude below a predetermined minimum level.

4. The method of claim 3 wherein the second electrode is spaced from between 0.005 inches and 0.250 inches from the first electrode.

5. The method of claim 4 wherein the alternating current signal is picked up at the second electrode by a detecting device which converts the alternating current signal to an analog signal.

6. The method of claim 5 wherein the resultant analog signal is sent to a processor for conversion or translation into a warning indication for the user.

7. The method of claim 5 performed on a replaceable liquid ink storage cartridge.

8. The method of claim 3 wherein the warning signal comprises an indicator light that turns on in response to sufficient amplitude, and the indicator light remains out in response to insufficient amplitude when the alternating current signal is detected and its amplitude determined.

9. The method of claim 8 wherein the alternating current signal is picked up at the second electrode by a detecting device which converts the alternating current signal to an analog signal.

10. The method of claim 9 wherein the resultant analog signal is sent to a processor for conversion or translation into a warning indication for the user.

11. The method of claim 8 performed on a replaceable liquid ink storage cartridge.

12. The method of claim 3 herein the alternating current signal is picked up at the second electrode by a detecting device which converts the alternating current signal to an analog signal.

13. The method of claim 12 wherein the resultant analog signal is sent to a processor for conversion or translation into a warning indication for the user.

14. The method of claim 3 performed on a replaceable liquid ink storage cartridge.

15. A method for determining the percentage of toner solids remaining in liquid printing ink within a liquid printing ink storage device or liquid ink use cartridge comprises:

providing an electrical signal generator in signal communication with the storage device or cartridge;

providing a first electrode electrically connected to the signal generator, the first electrode in electrical contact with the liquid printing ink;

providing a second electrode at a predetermined gap distance across the liquid printing ink from the first electrode, the second electrode in electrical contact with the liquid printing ink and connected to an electrical signal detector;

transmitting an electrical current signal having an amplitude from the signal generator to the first electrode;

detecting the electrical current signal or its absence with the electrical signal detector, determining the amplitude or absence of the electrical current signal at the second electrode, and generating a low toner solids warning signal in response to the amplitude being detected at the second electrode at an amplitude below a predetermined minimum level wherein the warning signal comprises an indicator light that stays on in response to sufficient amplitude, and the indicator light goes out in response to insufficient amplitude when the electrical current signal is detected and its amplitude determined.

16. A method for determining the percentage of toner solids remaining in liquid printing ink within a liquid printing ink storage device or liquid ink use cartridge comprises:

providing an electrical signal generator in signal communication with the storage device or cartridge;

providing a first electrode electrically connected to the signal generator, the first electrode in electrical contact with the liquid printing ink;

providing a second electrode at a Predetermined gap distance across the liquid printing ink from the first electrode, the second electrode in electrical contact with the liquid printing ink and connected to an electrical signal detector;

transmitting an electrical current signal having an amplitude from the signal generator to the first electrode;

detecting the electrical current signal or its absence with the electrical signal detector, determining the amplitude or absence of the electrical current signal at the second electrode, and generating a low toner solids warning signal in response to the amplitude being detected at the second electrode at an amplitude below a predetermined minimum level, wherein the warning signal comprises an indicator light that stays on in response to sufficient amplitude, and the indicator light goes out in response to insufficient amplitude when the electrical current signal is detected and its amplitude determined.

17. A method for determining the percentage of toner solids remaining in liquid printing ink within a liquid printing ink storage device or liquid ink use cartridge comprises:

providing an electrical signal generator in signal communication with the storage device or cartridge;

providing a first electrode electrically connected to the signal generator, the first electrode in electrical contact with the liquid printing ink;

providing a second electrode at a predetermined gap distance across the liquid printing ink from the first electrode, the second electrode in electrical contact with the liquid printing ink and connected to an electrical signal detector;

transmitting an electrical current signal having an amplitude from the signal generator to the first electrode;

detecting the electrical current signal or its absence with the electrical signal detector, determining the amplitude or absence of the electrical current signal at the second electrode, and generating a low toner solids warning signal in response to the amplitude being detected at the second electrode at an amplitude below a predetermined minimum level, wherein the warning signal comprises an indicator light that turns on in response to sufficient amplitude, and the indicator light remains out in response to insufficient amplitude when the electrical current signal is detected and its amplitude determined.

* * * * *